US009278551B2

(12) United States Patent
Sasaki et al.

(10) Patent No.: US 9,278,551 B2
(45) Date of Patent: Mar. 8, 2016

(54) LIQUID DISCHARGE APPARATUS

(71) Applicant: SEIKO EPSON CORPORATION, Tokyo (JP)

(72) Inventors: Tsuneyuki Sasaki, Matsumoto (JP); Eiji Kumai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/597,816

(22) Filed: Jan. 15, 2015

(65) Prior Publication Data

US 2015/0210090 A1 Jul. 30, 2015

(30) Foreign Application Priority Data

Jan. 30, 2014 (JP) ..... 2014-015930

(51) Int. Cl.
*B41J 2/01* (2006.01)
*B41J 11/00* (2006.01)
*B41J 11/06* (2006.01)

(52) U.S. Cl.
CPC ..... *B41J 11/002* (2013.01); *B41J 11/0015* (2013.01); *B41J 11/06* (2013.01)

(58) Field of Classification Search
CPC ..... B41J 11/002; B41J 11/06; B41J 11/0015
USPC ..... 347/102–104
See application file for complete search history.

(56) References Cited

U.S. PATENT DOCUMENTS

2014/0285601 A1* 9/2014 Sasaki et al. ..... 347/102

FOREIGN PATENT DOCUMENTS

| | | |
|---|---|---|
| JP | 10-217572 | 8/1998 |
| JP | 2000-075773 | 3/2000 |
| JP | 2009-134207 | 6/2009 |

* cited by examiner

*Primary Examiner* — An Do
(74) *Attorney, Agent, or Firm* — Workman Nydegger

(57) ABSTRACT

A liquid discharge apparatus includes a liquid discharging unit configured to discharge liquid onto a recording medium, a dryer unit configured to heat and dry the liquid, a medium supporting unit configured to support the recording medium while the liquid is dried by the dryer unit, the medium supporting unit having an opening section allowing vapor generated while the liquid is dried by the dryer unit to pass therethrough, a condensation causing member in contact with the medium supporting unit and configured to condense the vapor passed through the opening section, and a low thermal expansion member connected to the condensation causing member and having a smaller thermal expansion coefficient than the condensation causing member.

6 Claims, 12 Drawing Sheets

LIQUID DISCHARGE APPARATUS

BACKGROUND

1. Technical Field

The present invention relates to a liquid discharge apparatus.

2. Related Art

A liquid discharge apparatus including a medium supporting unit configured to support a recording medium has been used. For example, JP-A-10-217572 discloses an ink jet recording apparatus including a mesh member functioning as a medium supporting unit at a position near a heater used as a dryer unit. Through the mesh member, water vapor can be released to the outside. In addition, JP-A-2000-75773 discloses a recording apparatus including a sling functioning as a medium supporting unit configured to support a transfer material used as a recording medium. In the recording apparatus, a toner image transferred on the transfer material is caused to contact with a heating roller, which corresponds to a dryer unit, and water vapor is allowed to be expelled through the sling.

In recording apparatuses according to the related art, the medium supporting unit supporting the recording medium may be deformed in some cases. Particularly, in the medium supporting unit including the mesh member at the position near the heater, as disclosed in JP-A-10-217572, the mesh member may be thermally deformed. In addition, in the recording apparatus including the heating roller configured to be in contact with the transfer material used as the recording medium, which is supported by the sling functioning as the medium supporting unit, as disclosed in JP-A-2000-75773, the sling functioning as the medium supporting unit may be deformed due to a pressing force or to heat of the heating roller. Deformation of the medium supporting unit may cause deformation of the recording medium supported by the medium supporting unit. As a result, an image on the recording medium may be distorted, or the recording medium may not be properly transported.

SUMMARY

An advantage of some aspects of the invention is to reduce or control the deformation of the medium supporting unit supporting the recording medium, and to reduce the risk of deformation of the recording medium supported by the medium supporting unit.

A liquid discharge apparatus according to an aspect of the invention includes a liquid discharging unit, a dryer unit, a medium supporting unit, a condensation causing member, and a low-thermal expansion member. The liquid discharging unit is configured to discharge liquid onto a recording medium. The dryer unit is configured to heat and dry the liquid. The medium supporting unit is configured to support the recording medium while the liquid is dried by the dryer unit. The medium supporting unit has an opening section allowing vapor generated while the liquid is dried by the dryer unit to pass therethrough. The condensation causing member is in contact with the medium supporting unit and configured to condense the vapor passed through the opening section. The low thermal expansion member is connected to the condensation causing member and has a smaller thermal expansion coefficient than the condensation causing member.

In this aspect, the condensation causing member is connected to the low-thermal expansion member having a smaller thermal expansion coefficient than the condensation causing member. This reduces the deformation of the condensation causing member that may be caused by the heat from the dryer unit, and thus reduces the deformation of the medium supporting unit that is in contact with the condensation causing member. The "thermal expansion coefficient" (a rate of thermal expansion) is a rate of expansion per (° C.) in length or in volume of an object with an increase in temperature. The unit for this rate is 1/K. The thermal expansion coefficient (the rate of thermal expansion) includes both a volumetric thermal expansion coefficient (a rate of volumetric thermal expansion) and a linear expansion coefficient (a rate of linear expansion coefficient).

In the liquid discharge apparatus, the low thermal expansion member may be fastened to the condensation causing member.

In this case, the low thermal expansion member is fastened to the condensation causing member. Accordingly, the condensation causing member is tightly connected to the low-thermal expansion member having a smaller thermal coefficient than the condensation causing member. This effectively reduces the deformation of the condensation causing member, and thus reduces the deformation of the medium supporting unit that is in contact with the condensation causing member.

The liquid discharge apparatus may include an elastic member connecting the medium supporting unit and the low-thermal expansion member.

In this case, the medium supporting unit and the low-thermal expansion member are connected via the elastic member. With this configuration, the deformation of the medium supporting unit is reduced, since the medium supporting unit is connected to the low-thermal expansion member having a smaller thermal expansion coefficient than the condensation causing member. In addition, with this configuration, the medium supporting unit is tensioned, since the elastic member is also connected to the low-thermal expansion member. Accordingly, the deformation can be absorbed by elastic force of the elastic member if the position or the size of the medium supporting unit changes in relation to the low-thermal expansion member due to the deformation (expansion or contraction) of at least a part of the medium supporting unit by heat. This reduces the risk of the deformation of the recording medium supported by the medium supporting unit.

In the liquid discharge apparatus, the low-thermal expansion member may be fastened to a middle section of the condensation causing member.

In this case, the low-thermal expansion member is fastened to the middle section of the condensation causing member. With this configuration, the direction of the deformation (movement) of the condensation causing member can be controlled if the condensation causing member is largely thermally expanded toward the low-thermal expansion member. In other words, the condensation causing member is moved (deformed) in the direction laterally away from the middle section (a planar direction) based on the middle section thereof fastened to the low-thermal expansion member. This reduces the occurrence of irregularities of the condensation causing member, and thus reduces the risk of deformation of the recording medium supported by the medium supporting unit that is in contact with the condensation causing member. The "middle section" may include an exact central area and an area around the exact central area, that is, a slightly off-centered area. In addition, the middle section may be the middle in every direction or may be the middle in only one direction.

In the liquid discharge apparatus, the condensation causing member may include a first condensation causing member and a second condensation causing member. The first condensation causing member has openings allowing the vapor to pass therethrough. The second condensation causing member is configured to cause condensation of the vapor passed through the openings of the first condensation causing member.

In this case, the condensation causing member includes the first condensation causing member having the openings allowing the vapor to pass therethrough, and the second condensation causing member configured to cause condensation of the vapor passed through the openings of the first condensation causing member. With this configuration, the vapor can pass through the openings of the first condensation causing member to be expelled from the vicinity of the first condensation causing member and condense on the first and second condensation causing members. This lowers the vapor concentration, and thus effectively reduces the condensation of the vapor on the medium supporting unit.

In the liquid discharge apparatus, the medium supporting unit may include a mesh member.

In this case, the medium supporting unit includes the mesh member, which enables the opening section to be readily provided at a low cost. In addition, in this configuration, the vapor can pass through the opening section of the medium supporting unit to be expelled from the vicinity of the medium supporting unit and condense on the condensation causing member, which lowers the vapor concentration, and thus effectively reduces the condensation of the vapor on the medium supporting unit.

BRIEF DESCRIPTION OF THE DRAWINGS

The invention will be described with reference to the accompanying drawings, wherein like numbers reference like elements.

DESCRIPTION OF EXEMPLARY EMBODIMENT

A recording apparatus according to an embodiment of the present invention will be described in detail with reference to the attached drawings. The recording apparatus corresponds to a liquid discharge apparatus.

Figure 1:
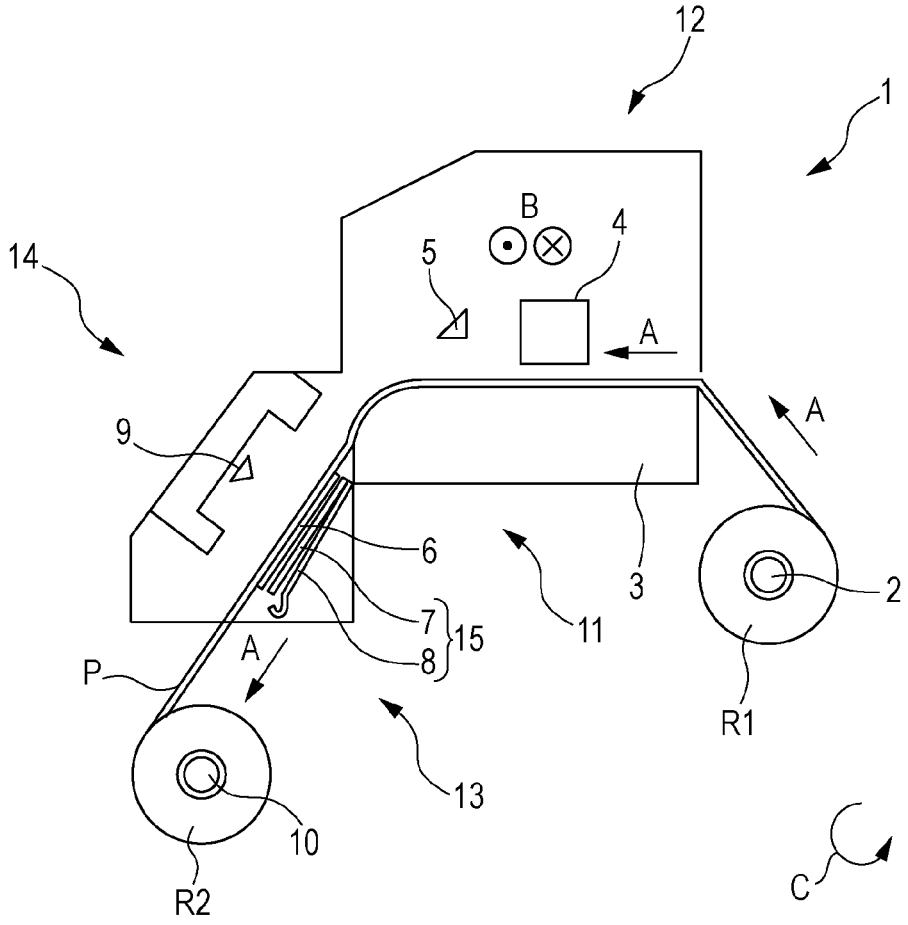
FIG. 1 is a schematic side view illustrating a recording apparatus in an embodiment of the invention.

A brief description of a recording apparatus 1 in an embodiment of the invention will be given. The recording apparatus 1 is configured to record an image such as a photo, a character, a mark, or an illustration on a recording medium P by a water-based ink. However, the recording apparatus is not limited to a recording apparatus that uses water-based ink. The recording apparatus 1 in this embodiment is illustrated in a schematic side view of FIG. 1.

The recording apparatus 1 includes a set portion 2 configured to send the recording medium P from a roll R1 for recording. The recording apparatus 1 uses the roll-type recording medium as the recording medium P, but the recording apparatus according to the invention is not limited to a recording apparatus that uses the roll-type recording medium. For example, the recording medium may be a single sheet or a cut sheet.

The recording apparatus 1 is configured to drive the set portion 2 to rotate in a rotation direction C so as to transport the recording medium P in a transporting direction A. At this time, the roll R1 disposed on the set portion 2 rotates along with the rotation of the set portion 2. The recording medium P is unrolled from the roll R1 along with the rotation of the roll R1 and transported in the transporting direction A.

The recording apparatus 1 includes a transporting mechanism 11 including a plurality of transporting rollers (not illustrated) to transport the recording medium P, which is a roll-type recording medium, in the transporting direction A on a platen 3. The set portion 2 may not be driven to rotate so as to transport the recording medium P in the transporting direction A. The set portion 2 may be configured to be passively rotated. The set portion 2 may be rotated by driving the transporting mechanism 11.

The recording apparatus 1 includes a recording mechanism 12 including a recording head 4 configured to record while being reciprocated in a transverse direction B intersecting the transporting direction A of the recording medium P. The recording head 4 corresponds to a liquid discharging unit. The recording head 4 is configured to discharge the ink onto the recording medium P. The ink discharged from the recording head 4 forms or records an image on the recording medium P.

The recording apparatus 1 includes the recording head 4 that is configured to record while being reciprocated, but may include a "line head" having a plurality of nozzles configured to discharge the ink. The nozzles may be arranged in the cross direction B intersecting the transporting direction A. The "line head" is a recording head that has a nozzle area extending so as to cover an overall length of the recording medium P in the cross direction B intersecting the transporting direction A of the recording medium P. The line head is used in a recording apparatus in which one of the recording head and the recording medium P is fixed while the other one of them is moved during the image formation. The nozzle area of the line head extending in the cross direction B may not cover the overall length in the cross direction B of every kind of recording medium P that can be used in the recording apparatus.

The recording mechanism 12 includes an infrared heater 5 configured to dry the ink discharged from the recording head 4. The infrared ray emitted from the infrared heater 5 has a wavelength of 0.76 to 1000 μm. Generally, the infrared ray can be grouped into a near-infrared ray, a middle-infrared ray, and a far-infrared ray, that have a wavelength region of about 0.78 to 2.5 μm, about 2.5 to 4.0 μm, and about 4.0 to 1000 μm, respectively. Each group may have a different definition. In this embodiment, the middle-infrared ray is preferable.

The recording apparatus 1 includes a medium support mechanism 13 downstream of the recording head 4 in the transport direction A of the recording medium P. The medium recording mechanism 13 includes a medium supporting unit 6 and a condensation causing member 15 including a first condensation causing member 7 and a second condensation causing member 8. The medium support mechanism 13 will be described in detail later.

The recording apparatus 1 includes a dryer mechanism 14 at a position facing the medium supporting unit 6. The dryer mechanism 14 is configured to heat and dry the recording medium P that is transported to the medium supporting unit 6 and the ink that is discharged onto the recording medium P. The dryer mechanism 14 includes an infrared heater 9 as a dryer unit. The recording apparatus 1 employs a radiation heat transfer method that uses the infrared heater 9 as the dryer unit. However, the recording apparatus may employ any dryer unit configured to dry the ink that is discharged from the recording head 4 onto the recording medium P. The kind, shape, placement, and the like of the dryer unit are not particularly limited. For example, the dryer unit may employ a convection heat drying method in which air such as hot air is blown against the recording medium P to evaporate the liquid by using the transferred heat. Alternatively, a dryer unit may employ an internal heat generation drying method in which microwaves are applied to the recording medium P to heat it from the inside. Methods may be used in combination.

The recording apparatus 1 includes a roll-up portion 10 downstream of the dryer mechanism 14 in the transporting direction A of the recording medium P. The roll-up portion 10 is configured to roll up the recording medium P in a roll R2 shape. In the recording apparatus 1, the roll-up portion 10 rotates in the rotation direction C to roll up the recording medium P.

Figure 2:
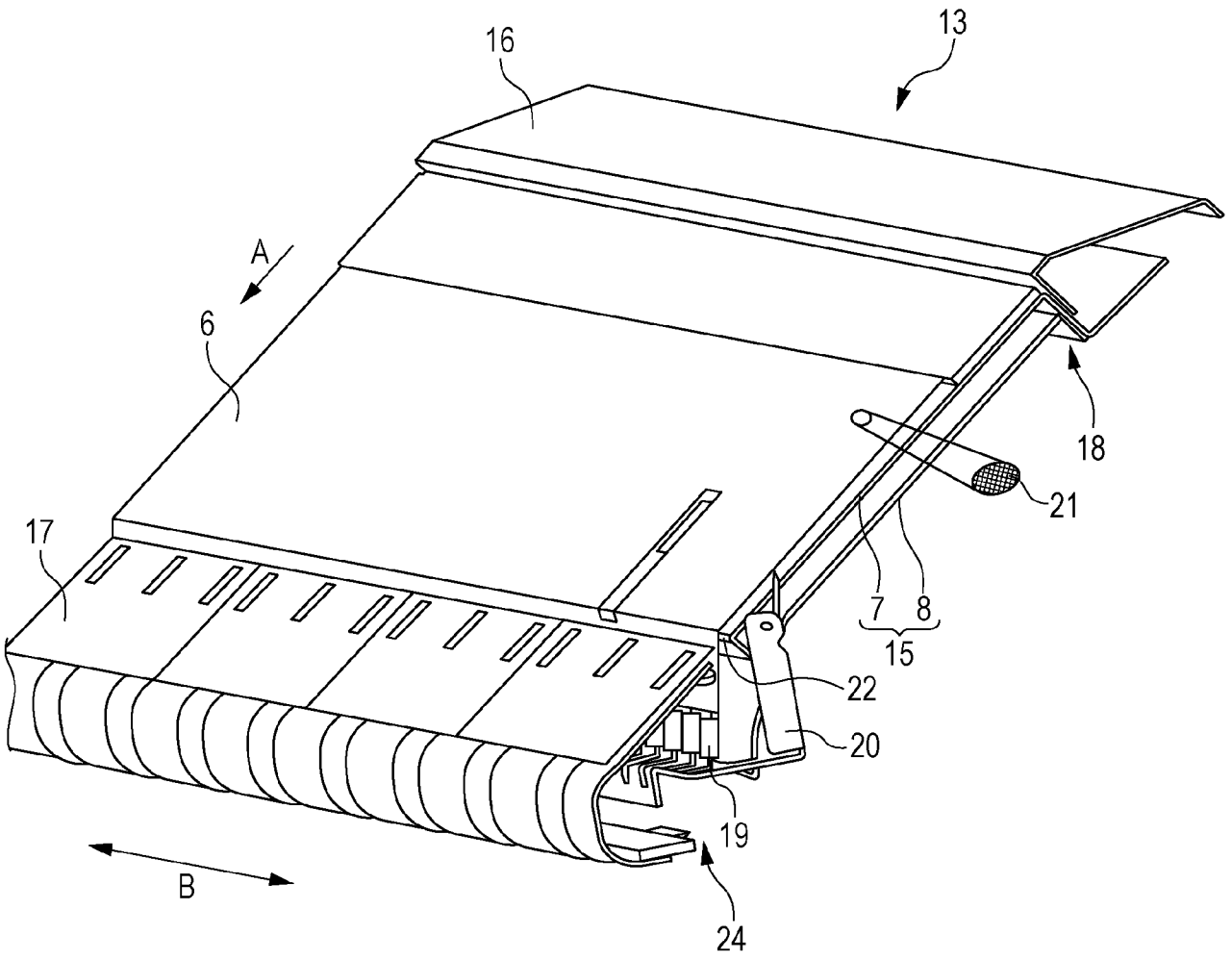
FIG. 2 is a schematic perspective view illustrating a medium support mechanism of the recording medium in an embodiment of the invention, where the medium support mechanism is viewed from a medium supporting unit side.
Figure 3:
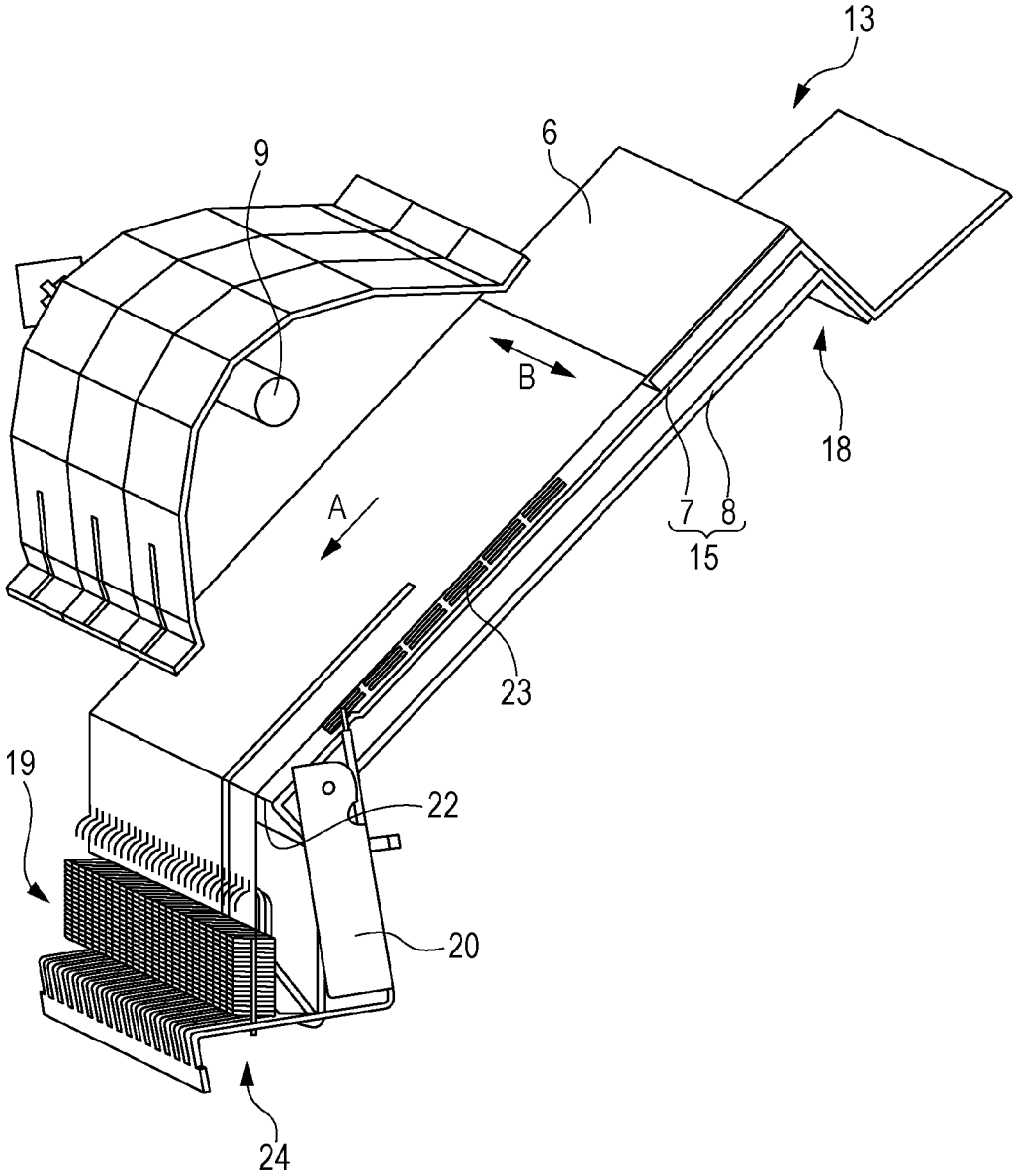
FIG. 3 is a schematic perspective view illustrating the medium support mechanism of the recording medium in an embodiment of the invention, where the medium support mechanism is viewed from the medium supporting unit side.

Next, the medium support mechanism 13 will be described in detail. The medium support mechanism 13 of the recording apparatus 1 in this embodiment is illustrated in schematic perspective views in FIGS. 2 and 3. In FIGS. 2 and 3, the medium support mechanism 13 is viewed from the medium supporting unit 6 side, i.e., obliquely from above. The medium supporting unit 6 in this embodiment is illustrated in a schematic perspective view in FIG. 4. The condensation causing member 15 in this embodiment is illustrated in a schematic perspective view in FIG. 5.

Figure 4:
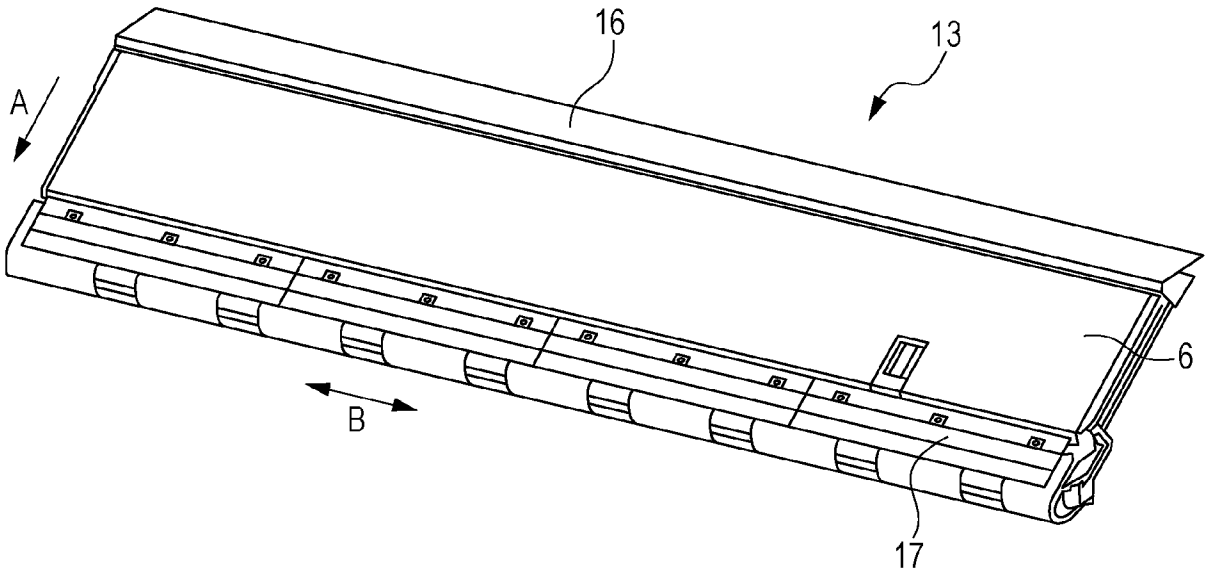
FIG. 4 is a schematic perspective view illustrating the medium supporting unit of the recording apparatus in an embodiment of the invention.

As illustrated in FIGS. 2 and 4, the medium support mechanism 13 in this embodiment includes the medium supporting unit 6, a first fixing member 16, and a second fixing member 17. The medium supporting unit 6 is disposed at a position facing the infrared heater 9 of the dryer mechanism 14 and is configured to support the recording medium P. The first fixing member 16 is disposed upstream of the medium supporting unit 6 in the transporting direction A and fixed to the medium supporting unit 6. The second fixing member 17 is disposed downstream of the medium supporting unit 6 in the transporting direction A and fixed to the medium supporting unit 6. Like the medium supporting unit 6, the first fixing member 16 and the second fixing member 17 are configured to support the recording medium P. In FIG. 3, the first fixing member 16 and the second fixing member 17 are not attached.

As indicated by a magnified part of the medium supporting unit 6 in FIG. 2, the medium supporting unit 6 in this embodiment has an opening section 21 that allows vapor generated during the drying process of the ink using the infrared heater 9 to pass therethrough. The medium supporting unit 6 includes the opening section 21 at least over an area that may be in contact with the recording medium P. Preferably, the medium supporting unit 6 has at least a part that is composed of a linear member. In addition, the medium supporting unit 6 preferably has a mesh-like structure (net-like structure) composed of linear members. The mesh-like structure appropriately supports the recording medium P and allows the vapor to pass through the medium supporting unit 6. An example of the linear member includes a thin linear metal such as a metal wire. However, the material thereof is not limited to metal. In the mesh-like structure, the meshes of the medium supporting unit 6 correspond to the opening section 21. A shape or the like of the opening section 21 is not particularly limited. Preferably, the opening section 21 has at least a part that is composed of a linear member having a diameter of 0.05 mm or more and 0.3 mm or less. In addition, an opening ratio of the opening section 21 to the medium supporting unit 6 is preferably 40% or more and less than 100%.

Figure 5:
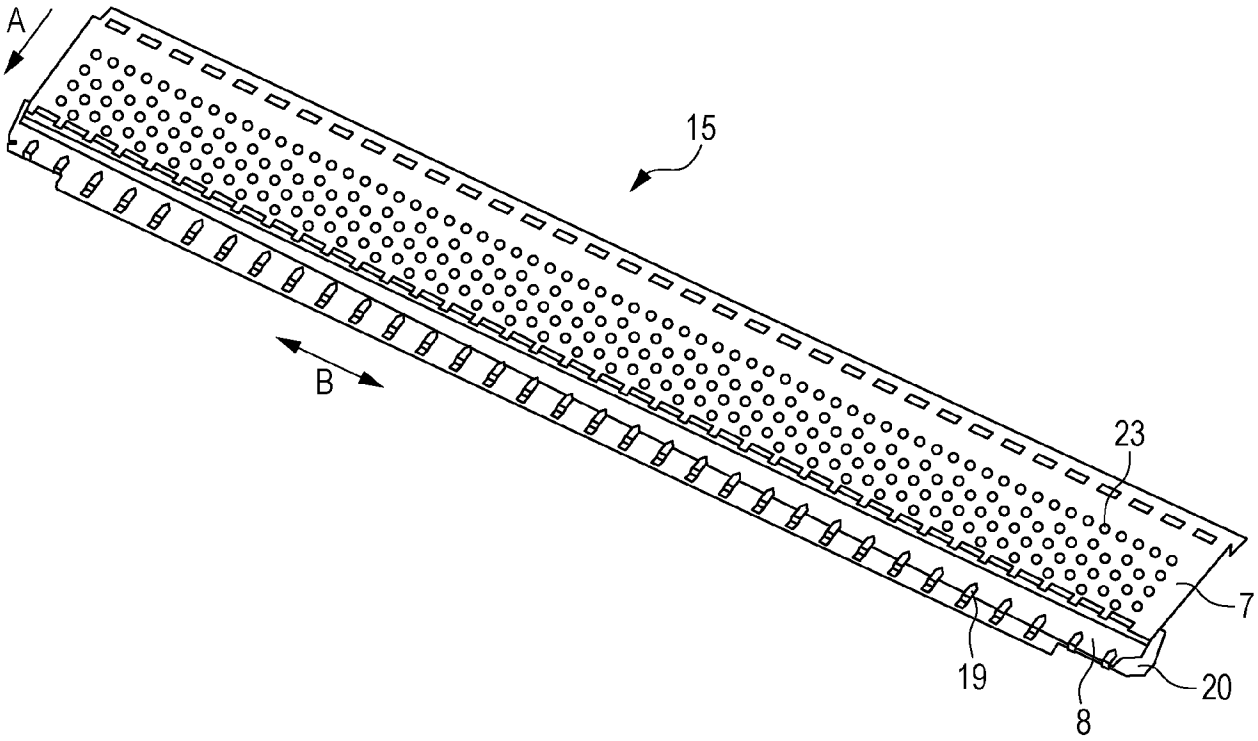
FIG. 5 is a schematic perspective view illustrating a condensation causing member of the recording apparatus in an embodiment of the invention.

The medium support mechanism 13 includes the condensation causing member 15 configured to condense the vapor passed through the opening section 21. The condensation causing member 15 includes the first condensation causing member 7 and the second condensation causing member 8 that are configured to condense the vapor passed through the opening section 21 of the medium supporting unit 6. As illustrated in FIG. 3 and FIG. 5, the first condensation causing member 7 has openings 23 configured to pass the vapor therethrough. The second condensation causing member 8 is composed of a plate member having no openings for passing the vapor therethrough. With this configuration, the vapor passed through the openings 23 of the first condensation causing member 7 can condense into liquid on the plate member.

As illustrated in FIG. 2 and FIG. 3, the medium supporting unit 6, the first condensation causing member 7, and the second condensation causing member 8 are fastened together at a fastening member 18 located upstream in the transporting direction A, and connected to a chassis of the recording apparatus 1. With this configuration, the upstream side of the medium supporting unit 6 is less likely to have a high temperature, because, on the upstream side of the medium supporting unit 6 in the transporting direction A, heat generated by the infrared heater 9 is likely to be transferred from the medium supporting unit 6 to the first condensation causing member 7, the second condensation causing member 8, and the chassis of the recording apparatus 1. Accordingly, the area on the upstream side of the medium supporting unit 6 in the transporting direction A is less likely to be subjected to thermal expansion by heat. However, the invention is not limited to this configuration. For example, the medium supporting unit 6, the first condensation causing member 7, and the second condensation causing member 8 may not be connected to the chassis at the upstream side in the transporting direction A.

On the other hand, at the downstream side in the transporting direction A, the medium supporting unit 6, the first condensation causing member 7, and the second condensation causing member 8 are not fastened together. With this configuration, at the downstream side in the transporting direction A, the medium supporting unit 6 is likely to have a high temperature and to be thermally expanded. However, as illustrated in FIG. 2 and FIG. 3, the recording apparatus 1 in this embodiment includes a tensioning mechanism 24 disposed downstream of the medium supporting unit 6 in the transporting direction A. The tensioning mechanism 24 includes a plurality of springs 19 as tensioning members that are arranged in the cross direction B intersecting the transporting direction A and configured to provide tension to the medium supporting unit 6. The medium supporting unit 6 is stretched by the springs 19, and thus the deformation of the medium supporting unit 6 to be caused by the thermal expansion of the medium supporting unit 6 is absorbed by the springs 19. This reduces the risk of deformation of the recording medium P supported by the medium supporting unit 6.

The recording apparatus 1 in this embodiment employs the spring 19 as a tensioning member, but the tensioning member is not limited to the spring 19. Preferably, an elastic member such as the spring 19 is used as the tensioning member. In this configuration, the medium supporting unit 6 is simply stretched by the elastic member, and thus the tensioning member can be readily provided at a low cost.

The recording apparatus 1 in this embodiment includes a reinforcing member 20 downstream of the second condensation causing member 8 in the transporting direction A. The reinforcing member 20 is a member that is less likely to be deformed than the medium supporting unit 6. The springs 19 are connected to both of the medium supporting unit 6 and the reinforcing member 20. Since the medium supporting unit 6 is connected to the reinforcing member 20 that is less likely to be deformed than the medium supporting unit 6 via the springs 19, the deformation of the medium supporting unit 6 is effectively reduced in the recording apparatus 1.

As described above, the recording apparatus 1 includes the recording head 4, which is configured to discharge ink onto the recording medium P, and the infrared heater 9, which is configured to heat and dry the ink. In addition, since the medium supporting unit 6 is disposed at the position facing the infrared heater 9, the medium supporting unit 6 supports the recording medium P while the ink is dried by the infrared heater 9. A recording apparatus that is configured to support the recording medium P by a medium supporting unit while the ink is dried by a dryer unit may be deformed by heat particularly at the medium supporting unit. However, the deformation of the medium supporting unit 6 is reduced in the recording apparatus 1, which has a similar configuration to that described above, since the deformation of the medium supporting unit 6 is absorbed due to the elastic force of the springs 19.

In the recording apparatus 1, the medium supporting unit 6 and the condensation causing member 15 are disposed at the position facing the infrared heater 9 functioning as an after heater, which is disposed downstream of the recording mechanism 12 in the transporting direction A. However, the medium supporting unit 6 and the condensation causing member 15 may be disposed at a position facing the infrared heater 5 used as a print heater included in the recording mechanism 12, i.e., they may be disposed on the platen 3.

As illustrated by a magnified part of the medium supporting unit 6 in FIG. 2, the medium supporting unit 6 in this embodiment includes the mesh member that has the opening section 21 allowing the vapor, which is generated during the drying process of the ink using the infrared heater 9, to pass therethrough. With this configuration, the vapor can be expelled from the vicinity of the medium supporting unit 6 through the opening section 21. This effectively reduces the condensation of the vapor on the medium supporting unit 6.

As described above, the recording apparatus 1 includes the condensation causing member 15 configured to cause the vapor passed through the opening section 21 to condense into liquid. With this configuration, in the recording apparatus 1, the vapor can be expelled from the vicinity of the medium supporting unit 6 through the opening section 21, and the vapor can condense on the condensation causing member 15. This lowers the vapor concentration, and thus effectively reduces the condensation of the vapor on the medium supporting unit 6.

The shape or the like of the opening section 21 is not particularly limited, but it is preferable that at least a part thereof be composed of a linear member having a diameter of 0.3 mm or less. With this configuration, the condensation of the vapor on a contact portion of the medium supporting unit 6 with the recording medium P can be properly reduced.

The opening ratio of the opening section 21 to the medium supporting unit 6 is preferably 40% or more. With this configuration, the condensation of the vapor on the contact portion of the medium supporting unit 6 with the recording medium P can be appropriately reduced.

As described above, the medium supporting unit 6 is composed of the mesh member. With this configuration, the opening section 21 of the medium supporting unit 6 in this embodiment can be readily produced at a low cost. In addition, with this configuration, the vapor can be expelled from the vicinity of the medium supporting unit 6 through the opening section 21, and the vapor can condense on the condensation causing member 15. This lowers the vapor concentration, and thus effectively reduces the condensation of the vapor on the medium supporting unit 6.

In the recording apparatus 1, in order to reduce the condensation of the vapor on the medium supporting unit 6, the medium supporting unit 6 is composed of a stainless steel (SUS defined in JIS), and the condensation causing member 15 (the first and second condensation causing members 7 and 8) is composed of aluminum, which has a higher thermal conductivity than the stainless steel. The condensation of the vapor on the condensation causing member 15 is caused by the condensation causing member 15 having a higher temperature conductivity than the medium supporting unit 6. This configuration reduces the condensation of the vapor on the medium supporting unit 6. However, the invention may employ configurations other than the above.

In the recording apparatus 1, the reinforcing member 20 is composed of an electro-galvanized steel sheet (SECC defined in JIS). However, the reinforcing member 20 is not limited to this configuration. The reinforcing member 20 may be composed of SUS, for example, when having a shape that is less likely to be deformed than the medium supporting unit 6.

Like the medium supporting unit 6 in this embodiment, it is preferable that at least a part of the medium supporting unit be made of stainless steel. Stainless steel is not only inexpensive and strong, but also low in temperature conductivity and thermal conductivity, such that if forms a large contact angle with a droplet generated by the condensation of the vapor and remains mainly dry. Accordingly, the condensation of the vapor on the medium supporting unit 6 is effectively reduced.

Alternatively, the medium supporting unit 6 may include a member made of a nickel-plated or chrome-plated metal other than stainless steel, such as steel or iron. Such a member is low in temperature conductivity and thermal conductivity, such that it forms a large contact angle with a droplet generated by the condensation of the vapor and remains mainly dry. Accordingly, the condensation of the vapor on the medium supporting unit 6 is appropriately reduced.

The reinforcing member 20 is not only less likely to be physically deformed, but also less likely to be thermally deformed than the medium supporting unit 6. Thus, the reinforcing member 20 is a low thermal expansion member having a smaller thermal expansion coefficient than the condensation causing member 15. In other words, the recording apparatus 1 includes the reinforcing member 20 that is connected to the condensation causing member 15 and has a smaller thermal expansion coefficient than the condensation causing member 15.

In the recording apparatus 1, the medium supporting unit 6 is in contact with a ridge in the transporting direction A of a downstream side end 22 of the first condensation causing member 7. In other words, the condensation causing member 15 is in contact with the medium supporting unit 6. In such a configuration, deformation of the condensation causing member 15 may cause deformation of the medium supporting unit 6. The deformation of the medium supporting unit 6 may be caused by not only a factor relating to the medium supporting unit 6 itself, but also a factor relating to the condensation causing member 15. However, in the recording apparatus 1, the condensation causing member 15 is connected to the reinforcing member 20 that has a smaller thermal expansion coefficient than the condensation causing member 15. This reduces the deformation of the condensation causing member 15 due to heat from the infrared heater 9, and thus reduces the deformation of the medium supporting unit 6 that is in contact with the condensation causing member 15.

As described above, in the recording apparatus 1, the medium supporting unit 6 and the reinforcing member 20 are connected via the springs 19. In this configuration, the deformation of the medium supporting unit 6 is reduced by the connection of the medium supporting unit 6 and the reinforcing member 20, which has a smaller thermal expansion coefficient than the condensation causing member 15. In addition, the medium supporting unit 6 is tensioned since the springs 19 are connected to the reinforcing member 20. The medium supporting unit 6 is tensioned and stretched, and thus the deformation of the medium supporting unit 6 is effectively reduced.

In the recording apparatus 1, the reinforcing member 20 is fastened to the condensation causing member 15. This will be described in detail later. In such a configuration, the condensation causing member 15 is tightly connected to the reinforcing member 20 having a smaller thermal coefficient than the condensation causing member 15. This effectively reduces the deformation of the condensation causing member 15, and thus reduces the deformation of the medium supporting unit 6 that is in contact with the condensation causing member 15.

As described above, in the recording apparatus 1, the condensation causing member 15 includes the first condensation causing member 7 and the second condensation causing member 8. As illustrated in FIG. 3 and FIG. 5, the first condensation causing member 7 has the openings 23 that allow the vapor to pass therethrough. The second condensation causing member 8 is configured to allow the vapor that has passed through the openings 23 to condense into liquid. In the recording apparatus 1, the vapor is expelled from the vicinity of the first condensation causing member 7 through the openings 23, and is allowed to condense into liquid on the first condensation causing member 7 and the second condensation causing member 8. This lowers the vapor concentration, and thus effectively reduces the condensation of the vapor on the medium supporting unit 6.

Figure 6:
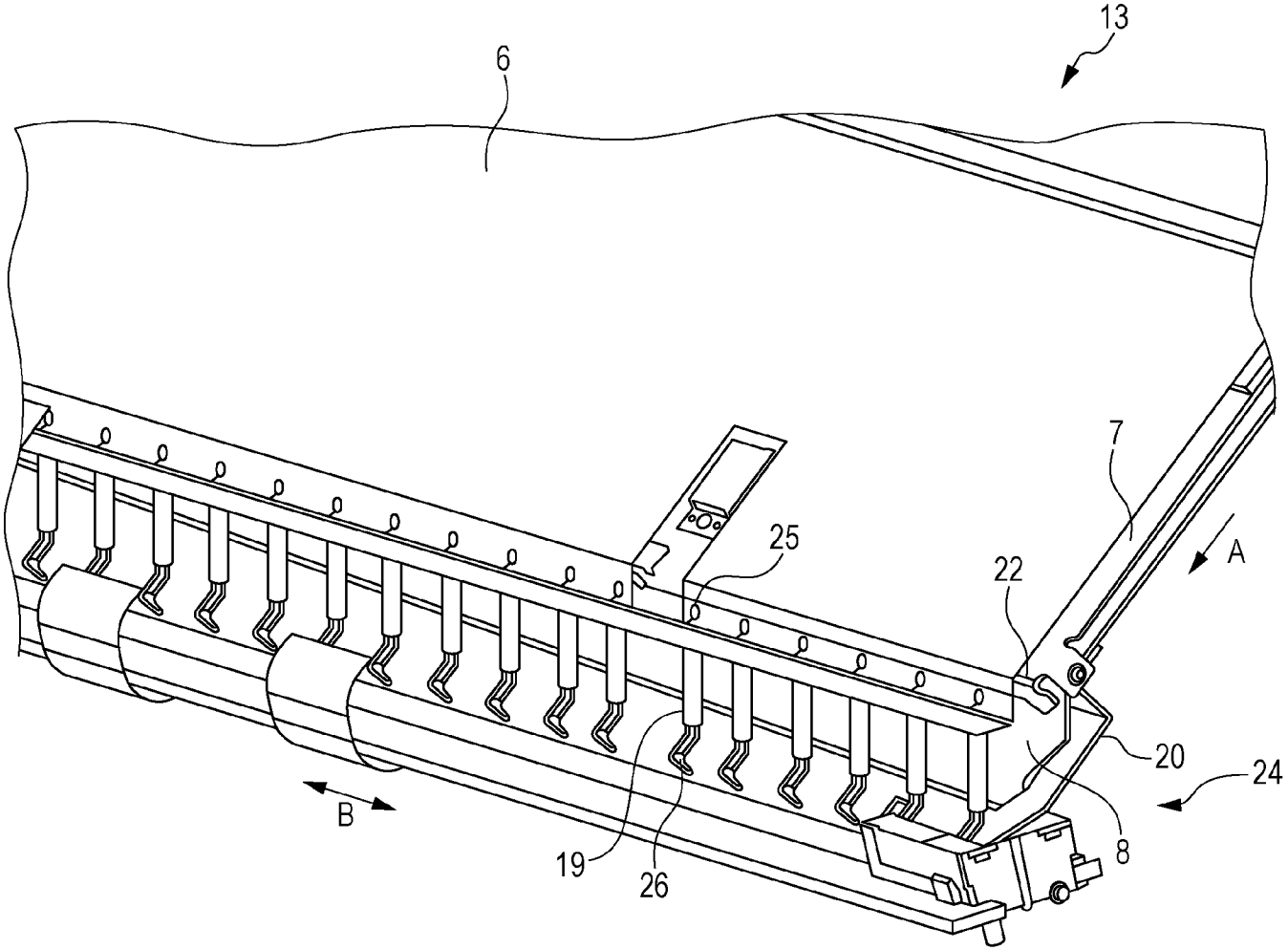
FIG. 6 is a schematic perspective view illustrating the medium support mechanism of the recording apparatus in an embodiment of the invention.
Figure 7:
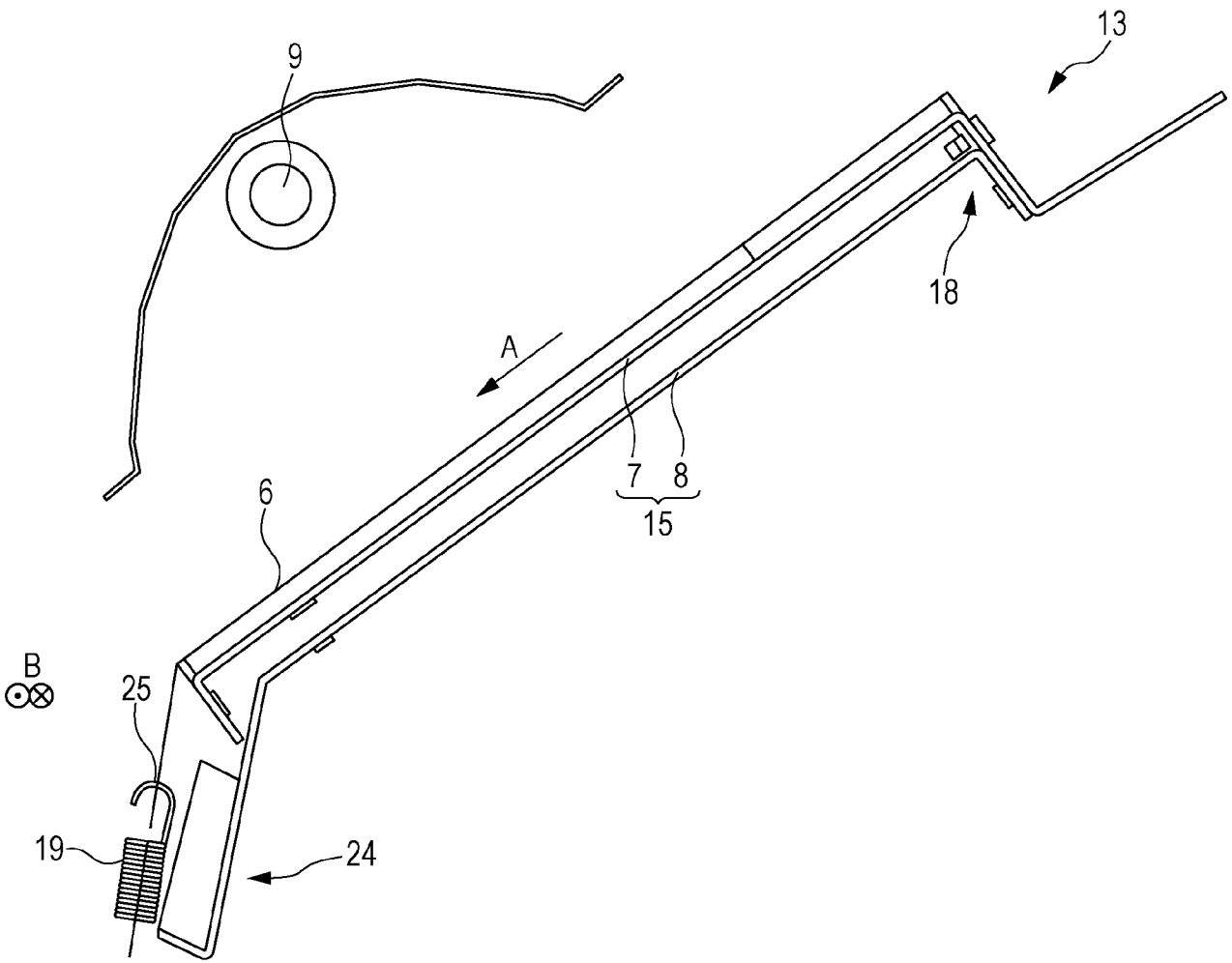
FIG. 7 is a schematic cross-sectional side view illustrating the medium support mechanism of the recording apparatus in an embodiment of the invention.
Figure 8:
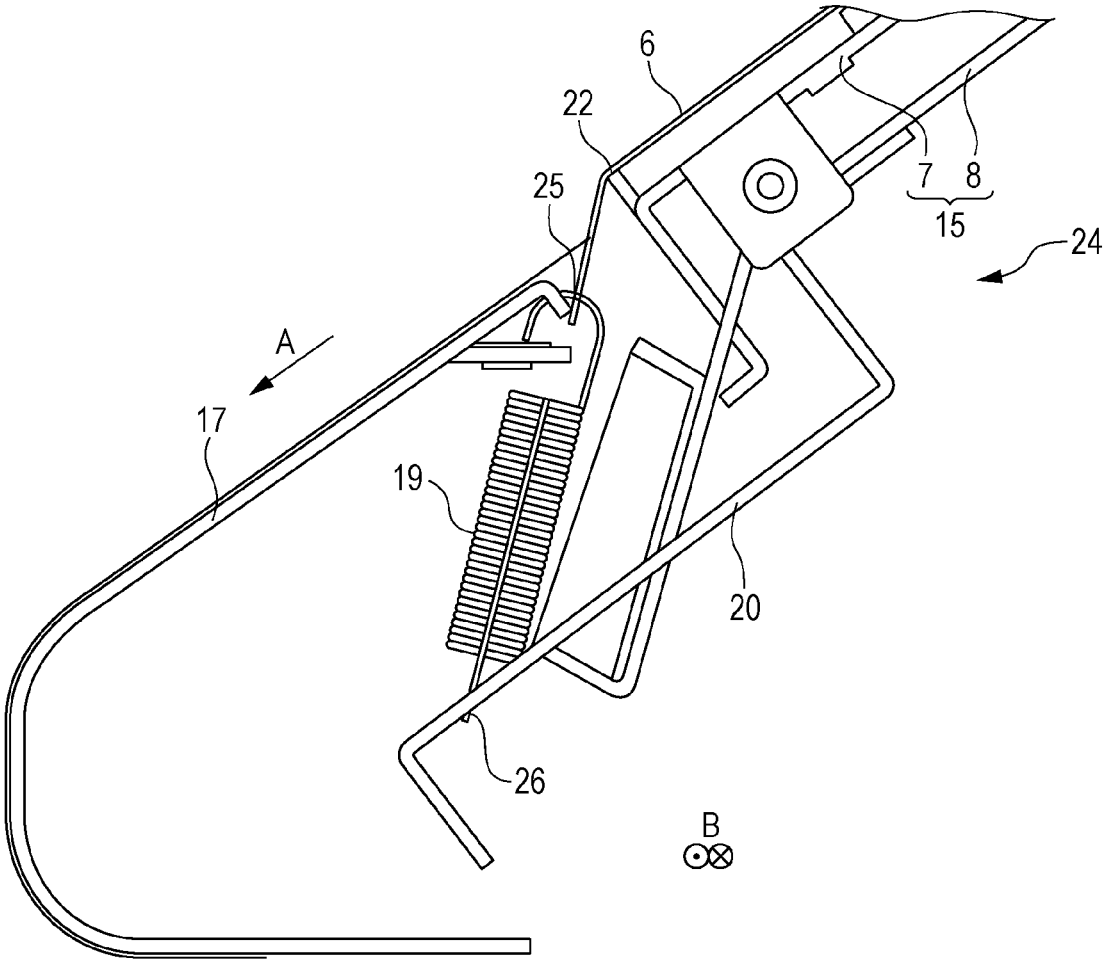
FIG. 8 is a schematic cross-sectional side view illustrating a tensioning mechanism of the recording apparatus in an embodiment of the invention.

Next, the tensioning mechanism 24 of the recording apparatus 1 in this embodiment will be described in detail. FIG. 6 is a schematic perspective view illustrating the medium support mechanism 13 of the recording apparatus 1 in this embodiment. FIG. 7 is a schematic cross-sectional side view illustrating the medium support mechanism 13 of the recording apparatus 1 in this embodiment. FIG. 7 illustrates the medium support mechanism 13 from which the reinforcing member 20 is removed. FIG. 8 is a schematic cross-sectional side view of the tensioning mechanism 24 of the recording apparatus 1 in this embodiment.

As illustrated in FIG. 6, the medium supporting unit 6 includes a plurality of holes 25 located along the transverse direction B at an end thereof in the transporting direction A. The reinforcing member 20 includes a plurality of holes 26 at positions corresponding to the holes 25 of the medium supporting unit 6. As illustrated in FIG. 6 and FIG. 8, the springs 19 are hooked into the holes 25 of the medium supporting unit 6 and the holes 26 of the reinforcing member 20 to connect the medium supporting unit 6 and the reinforcing member 20 such that the medium supporting unit 6 and the ridge in the transporting direction A of the downstream side end 22 of the first condensation causing member 7 are in contact with each other. In other words, the medium supporting unit 6 is stretched in the transporting direction A by the springs 10 that are connected to the reinforcing member 20, and thus the medium supporting unit 6 is tensioned by the springs 19. In this way, the medium supporting unit 6 is tensioned in an area facing the infrared heater 9.

As described above, in the recording apparatus 1, the medium supporting unit 6, the first condensation causing member 7, and the second condensation causing member 8 are not fastened together at the downstream side in the transporting direction A. Accordingly, the medium supporting unit 6 is likely to have a high temperature and be thermally expanded at the downstream side in the transporting direction A. However, since the medium supporting unit 6 is tensioned by the springs 19 at the downstream side in the transporting direction A, the deformation of the medium supporting unit 6 is effectively reduced.

Figure 9:
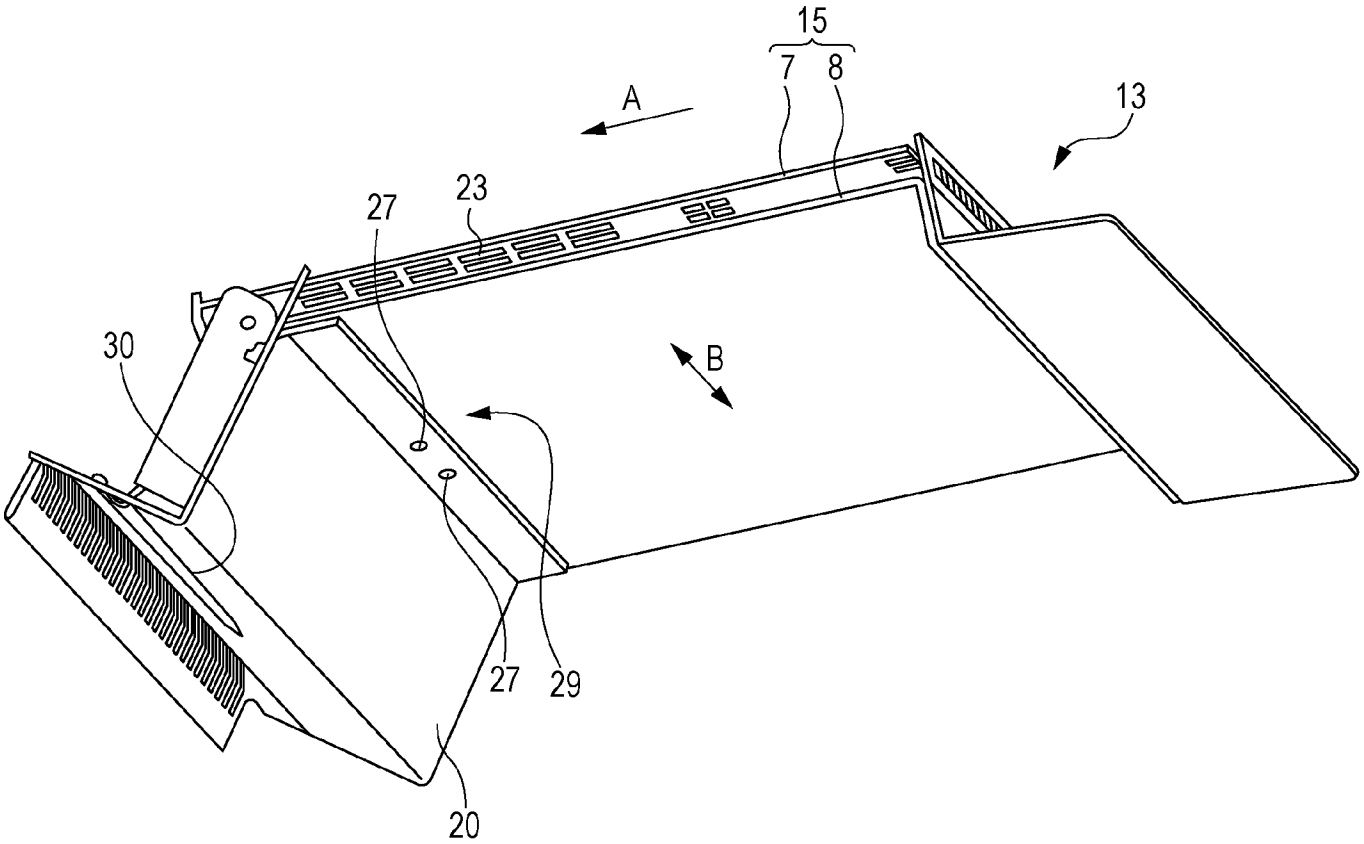
FIG. 9 is a schematic perspective view illustrating the medium support mechanism of the recording apparatus in an embodiment of the invention, where the medium support mechanism is viewed from a condensation causing member side.
Figure 10:
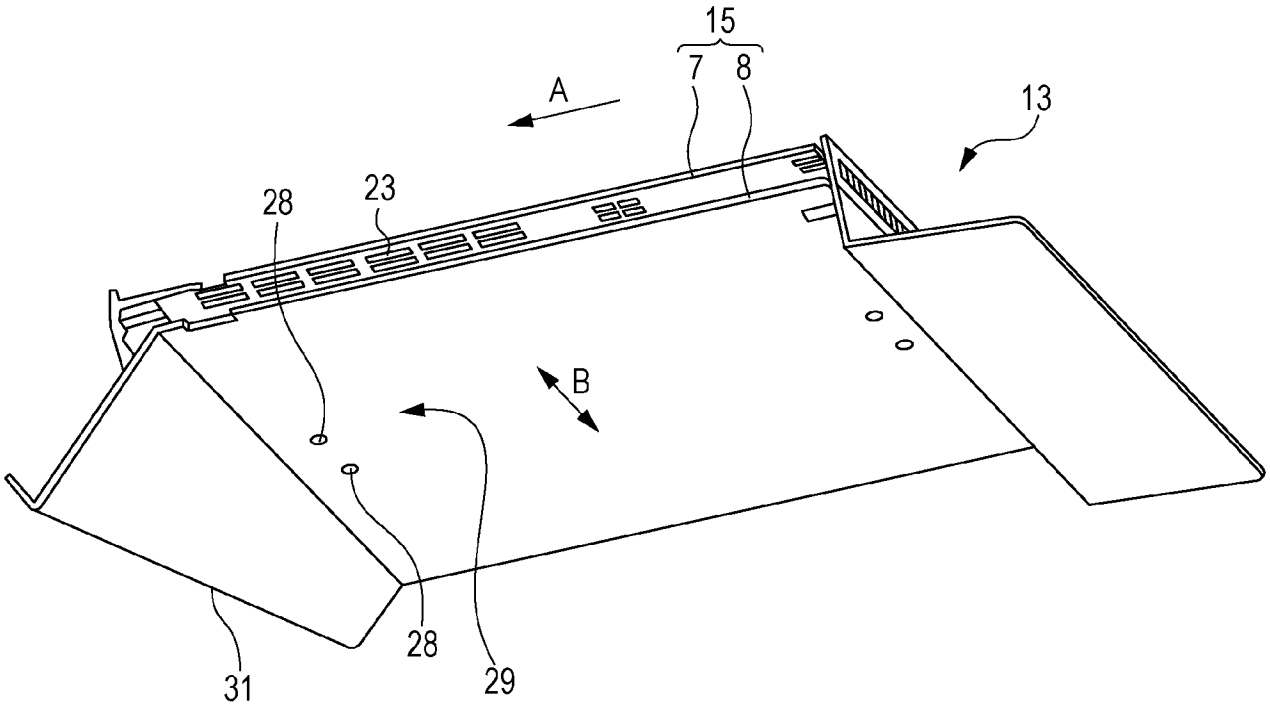
FIG. 10 is a schematic perspective view illustrating the medium support mechanism of the recording apparatus in an embodiment of the invention, where the medium support mechanism is viewed from the condensation causing member side.
Figure 11:
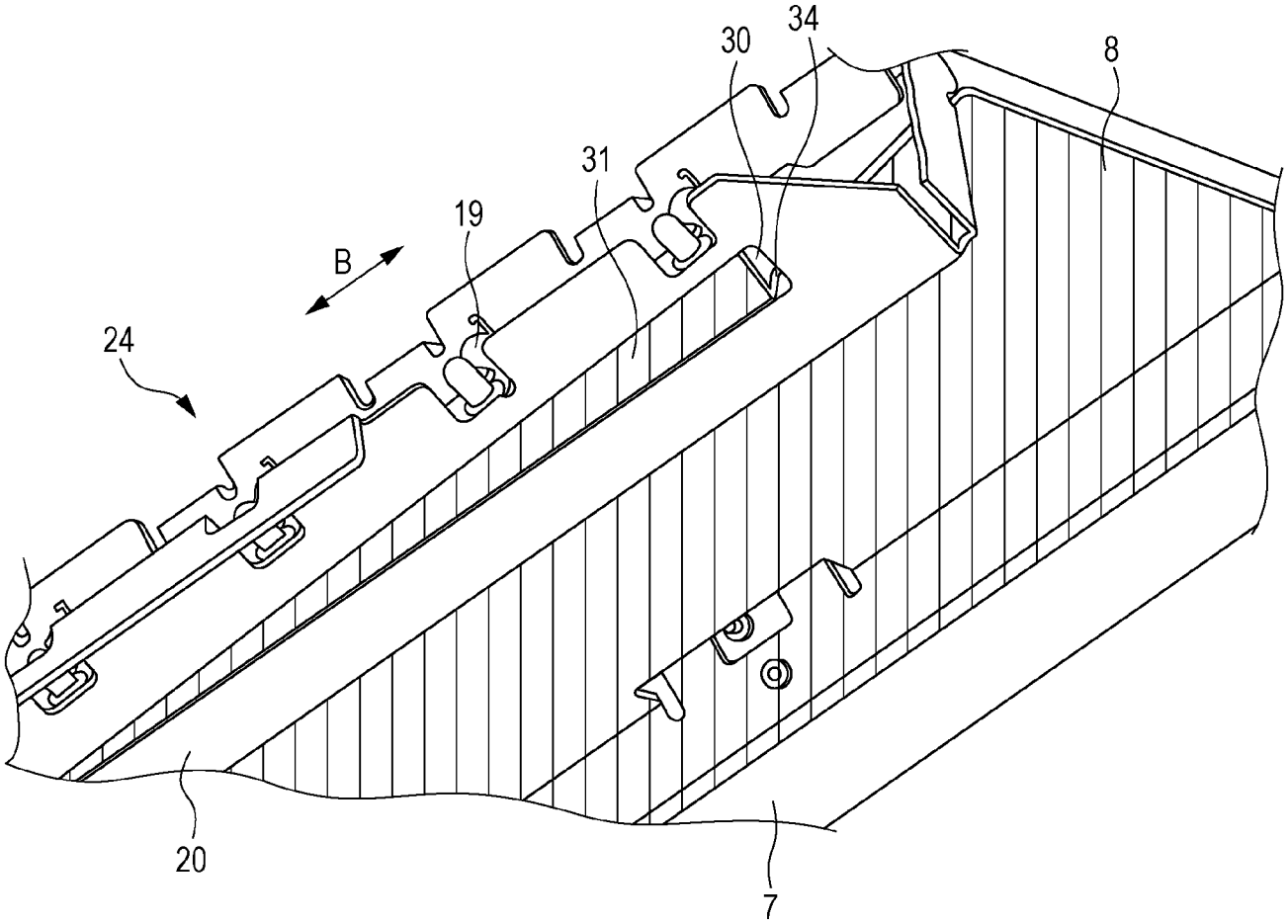
FIG. 11 is a schematic perspective view illustrating the tensioning mechanism of the recording apparatus in an embodiment of the invention, where The tensioning mechanism is viewed from the condensation causing member side.
Figure 12:
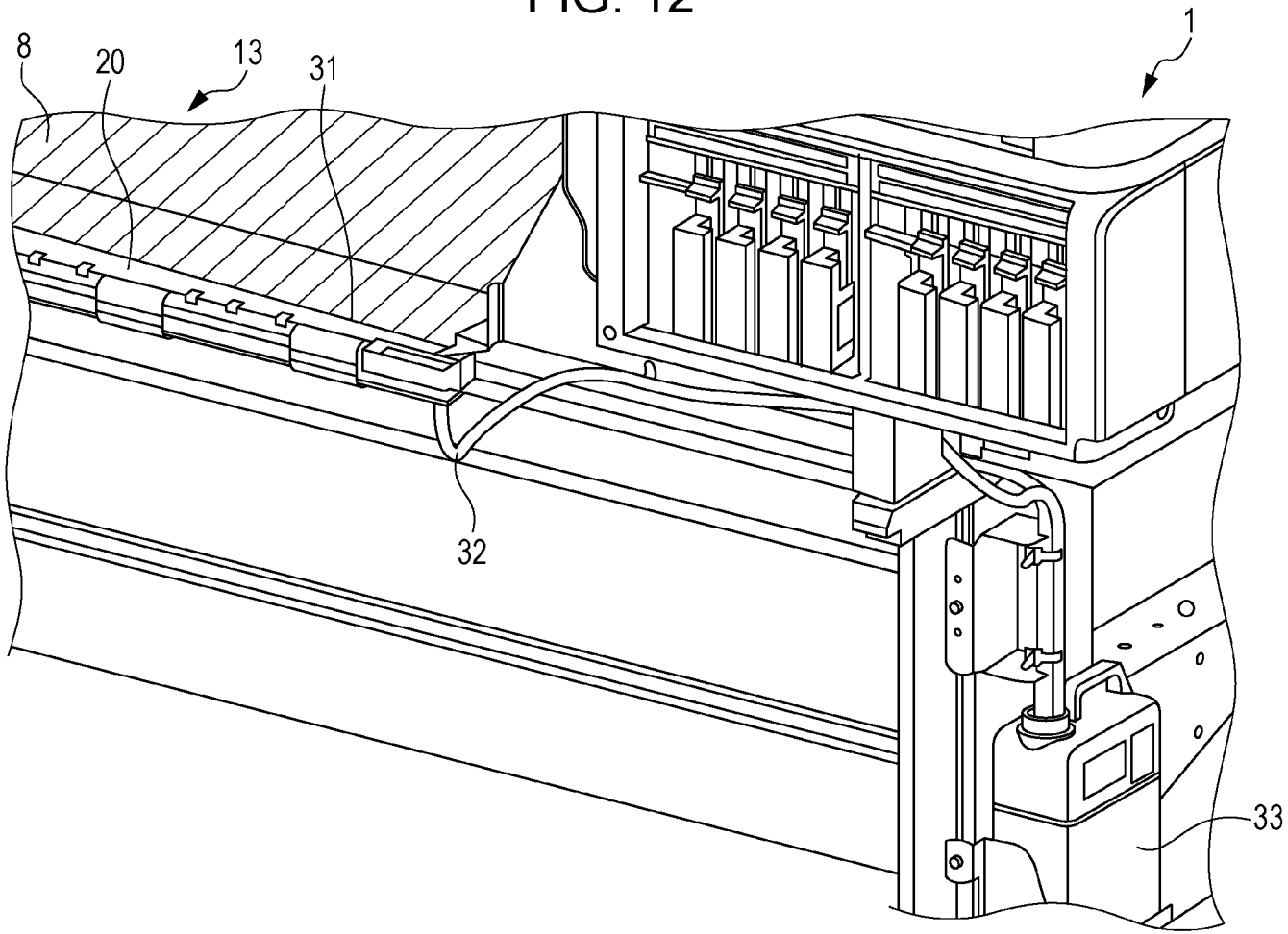
FIG. 12 is a schematic perspective view illustrating a route for collecting liquid generated by condensation of the vapor in the recording apparatus in an embodiment of the invention.

Next, how the reinforcing member 20 is fastened to the condensation causing member 15 will be described in detail. FIG. 9 and FIG. 10 are schematic perspective views illustrating the medium support mechanism 13 of the recording apparatus 1 in this embodiment. In FIG. 9 and FIG. 10, the medium support mechanism 13 is viewed from the condensation causing member 15 side, i.e., obliquely from below, and the medium supporting unit 6 is not attached. In FIG. 9, the reinforcing member 20 is fastened to the condensation causing member 15. In FIG. 10, the reinforcing member 20 is not attached to the condensation causing member 15. FIG. 11 is a schematic perspective view illustrating the tensioning mechanism 24 of the recording apparatus 1 in this embodiment. In FIG. 11, the tensioning mechanism 24 is viewed from the condensation causing member 15 side, and the medium supporting unit 6 is not attached. FIG. 12 is a schematic perspective view illustrating a route for collecting the liquid generated by the condensation of the vapor in the recording apparatus 1. In FIG. 12, the medium supporting unit 6 and the first condensation causing member 7 are not attached.

As illustrated in FIG. 9 and FIG. 10, in the recording apparatus 1, the second condensation causing member 8 has a threaded hole 28 at a middle section thereof in the transverse direction B. A screw 27 is screwed into the threaded hole 28 so as to fasten the reinforcing member 20 to the second condensation causing member 8. In other words, in the recording apparatus 1, the reinforcing member 20 functioning as the low thermal expansion member is fastened to the middle section of the condensation causing member 15.

With this configuration, the condensation causing member 15 can be moved (deformed) in the transverse direction B with respect to the reinforcing member 20 based on the middle section 29 if the condensation causing member 15 is largely thermally deformed toward the reinforcing member 20. This reduces not only the deformation of the reinforcing member 20 and the condensation causing member 15, but also the movement distance of the condensation causing member 15 toward the reinforcing member 20. The middle section 29 may include not only an exact central area, but also a slightly off-centered area. In addition, the middle section 29 may not be the middle in every direction and may be the middle in only one direction, as in this embodiment. In this embodiment, the middle section 29 is the middle section in the transverse direction B.

As illustrated in FIG. 10 and FIG. 11, the second condensation causing member 8 includes a rain gutter shaped bent portion 31 that protrudes downward while being elongated in the transverse direction B. As illustrated in FIG. 9 and FIG. 11, the reinforcing member 20 includes a cutout 30 that allows the bent portion 31 to be inserted thereto. The cutout 30 has a width gradually increasing from one side to the other side in the transverse direction B. As illustrated in FIG. 10, the bent portion 31 has a height gradually decreasing from one side to the other side in the transverse direction B.

As illustrated in FIG. 12, since the recording apparatus 1 includes the bent portion 31 having a height gradually decreasing from the one side to the other side in the transverse direction B, the liquid generated by the condensation of the vapor on the second condensation causing member 8 is forced to move on the bent portion 31 in a direction D. Then, the liquid is collected by a waste liquid bottle 33 after being passed through a tube 32.

In the recording apparatus 1, the bent portion 31 is inserted into the cutout 30, and as illustrated in FIG. 11, the cutout 30 is configured to have a gap 34 at its end with respect to the bent portion 31 in the transverse direction B. This allows the second condensation causing member 8 to move in the transverse direction B with respect to the reinforcing member 20 if the second condensation causing member 8 expands largely against the reinforcing member 20. Accordingly, the deformation of the second condensation causing member 8 and the reinforcing member 20 is reduced.

The entire disclosure of Japanese Patent Application No. 2014-015930, filed Jan. 30, 2014 is expressly incorporated reference herein.

What is claimed is:

1. A liquid discharge apparatus comprising:

a liquid discharging unit configured to discharge liquid onto a recording medium;

a dryer unit configured to heat and dry the liquid;

a medium supporting unit configured to support the recording medium while the liquid is dried by the dryer unit, the medium supporting unit having an opening section allowing vapor generated while the liquid is dried by the dryer unit to pass therethrough;

a condensation causing member in contact with the medium supporting unit and configured to condense the vapor passed through the opening section; and a low thermal expansion member connected to the condensation causing member and having a smaller thermal expansion coefficient than the condensation causing member.

2. The liquid discharge apparatus according to claim 1, wherein the low thermal expansion member is fastened to the condensation causing member.

3. The liquid discharge apparatus according to claim 2, wherein the low thermal expansion member is fastened to a middle section of the condensation causing member.

4. The liquid discharge apparatus according to claim 1, further comprising an elastic member connecting the medium supporting unit and the low thermal expansion member.

5. The liquid discharge apparatus according to claim 1, wherein the condensation causing member includes:

a first condensation causing member having openings configured to allow the vapor to pass therethrough; and a second condensation causing member configured to cause condensation of the vapor passed through the openings of the first condensation causing member.

6. The liquid discharge apparatus according to claim 1, wherein the medium supporting unit includes a mesh member.

* * * * *